US005899124A

United States Patent [19]

Cross, Jr.

[11] Patent Number: 5,899,124

[45] Date of Patent: May 4, 1999

[54] TREE STEP DRIVING TOOL

[76] Inventor: Donald Lee Cross, Jr., 1621 W. Larkwood, DeWitt, Mich. 48820

[21] Appl. No.: 08/794,952

[22] Filed: Feb. 4, 1997

[51] Int. Cl.[6] ..... B25B 13/48

[52] U.S. Cl. ..... 81/176.15; 81/177.2; 81/124.4; 81/44

[58] Field of Search ..... 81/176.1, 176.15, 81/176.2, 121.1, 124.2, 124.3, 124.4, 124.7, 44, 487, 901, 180.1, 184, 185.2, 489, 177.1, 177.2; 16/113, 110 R, 114 R; 7/138, 158, 167, 169, 170

[56] References Cited

U.S. PATENT DOCUMENTS

| | | | |
|---|---|---|---|
| 295,880 | 3/1884 | Lorillard . | |
| 723,848 | 3/1903 | Driehaus | 7/167 |
| 841,472 | 1/1907 | Vanderherchen . | |
| 855,905 | 6/1907 | Rhoads . | |
| 882,937 | 3/1908 | Fegley . | |
| 944,534 | 12/1909 | Beaman . | |
| 1,181,565 | 5/1916 | Block . | |
| 1,420,701 | 6/1922 | Hoffman . | |
| 1,434,401 | 11/1922 | Mueller . | |
| 1,493,983 | 5/1924 | Hurley | 81/177.2 |
| 2,437,762 | 3/1948 | Simonin . | |
| 2,522,428 | 9/1950 | Brunstad . | |
| 2,642,105 | 6/1953 | Alliano . | |
| 2,978,938 | 4/1961 | Nalley | 81/177.2 X |
| 3,742,789 | 7/1973 | Rusk et al. . | |
| 3,843,981 | 10/1974 | Verest | 81/177.2 X |
| 4,275,621 | 6/1981 | Mallot, Sr. . | |
| 4,509,393 | 4/1985 | Castiglione . | |
| 4,729,281 | 3/1988 | Holloway, Jr. | 81/177.2 |
| 4,756,181 | 7/1988 | Appelgren | 81/177.2 X |
| 4,905,547 | 3/1990 | Nigrelli | 81/176.15 |
| 5,477,758 | 12/1995 | Cunningham | 81/124.4 X |

FOREIGN PATENT DOCUMENTS

| | | | |
|---|---|---|---|
| 387366 | 5/1908 | France | 81/177.2 |
| 840339 | 1/1939 | France | 81/177.2 |

*Primary Examiner*—D. S. Meislin
*Attorney, Agent, or Firm*—Mick A. Nylander

[57] ABSTRACT

A step driving tool including an elongated rigid body having a first end and an oppositely disposed second end, a front sidewall and an oppositely disposed back sidewall and a first connecting wall and a second connecting wall whereby the front sidewall, back sidewall, first connecting sidewall and second connecting sidewall all extend substantially from the first end to the second end of the elongated rigid body, the front sidewall and back sidewall are each connected at one side to the primary connecting sidewall and are each connected at an opposite side to the second connecting sidewall, the rigid body having a opening defined therein, at the first end, for receiving a tree step having an extending screw portion, the front sidewall including a notch starting at the first end of the rigid body and extending toward the second end for receiving the extending screw portion and a handle disposed on the second connecting sidewall of the rigid body and extending out away from the second connecting sidewall whereby when the handle is rotated, sufficient torque is transferred from the rigid body to the tree step to rotate the tree step into a tree trunk.

27 Claims, 4 Drawing Sheets

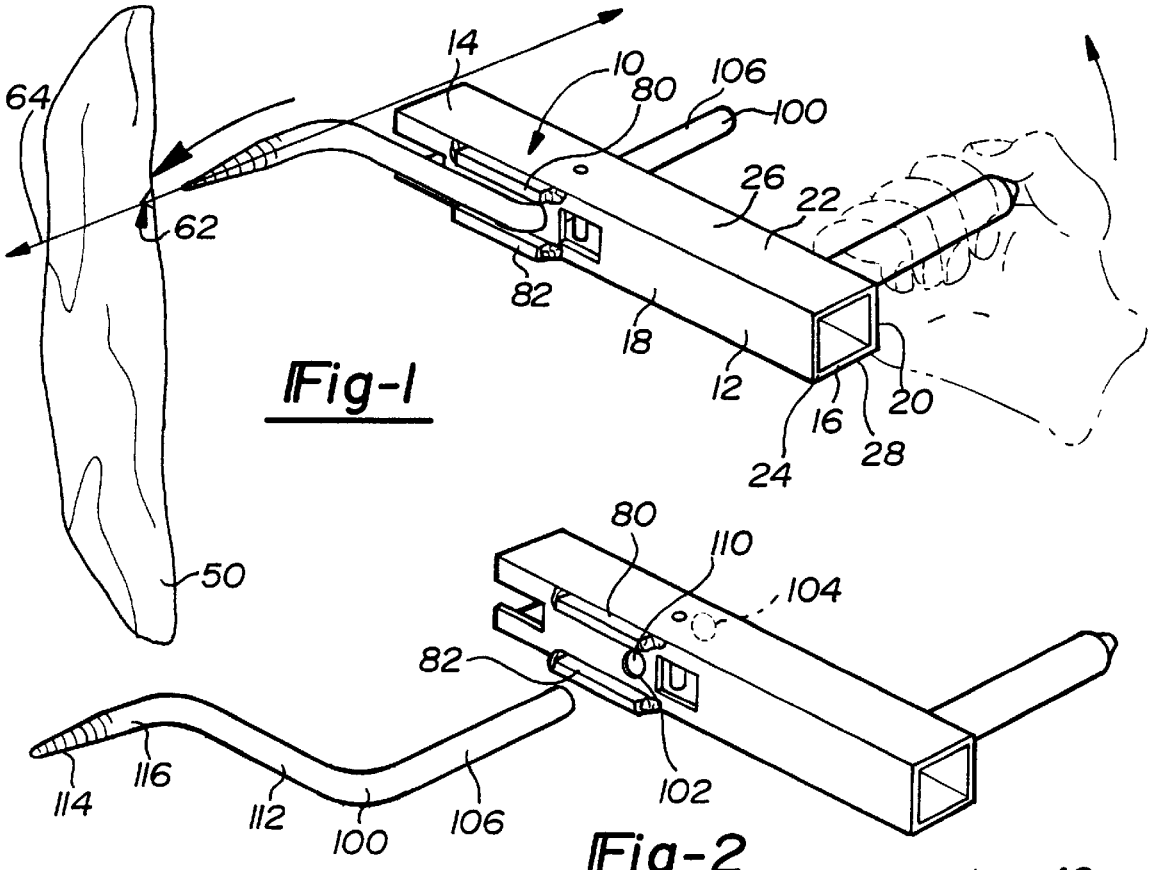
Fig-1
Fig-2
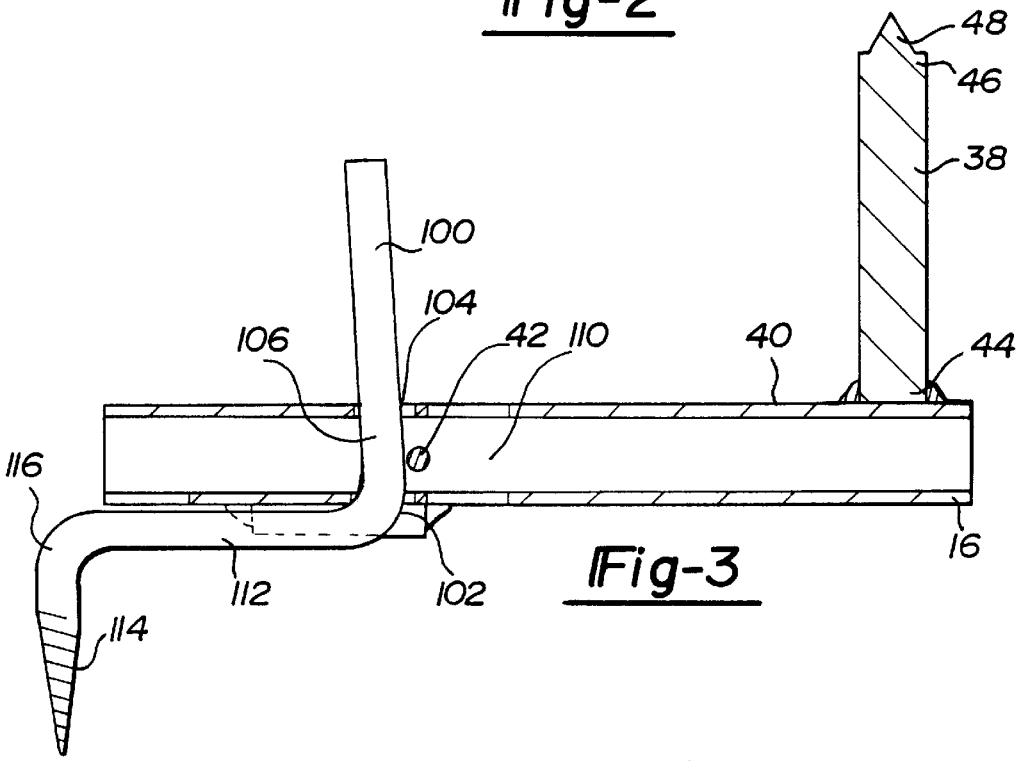
Fig-3

TREE STEP DRIVING TOOL

TECHNICAL FIELD

The present invention relates to a step driving tool and more particularly, to a portable one-piece tree step installing tool for driving a variety of portable steps into a tree trunk.

BACKGROUND ART

Bow hunting is a popular and growing sport throughout the country and the world. It is known that certain advantages are provided to the bow hunter if the bow hunter is located in a tree. Target angles are more advantageous if the hunter is located high up in a tree from 10 feet to 15 feet above the ground. In addition to advantageous target angles, various natural obstructions are removed when the bow hunter is located above the ground. For these reasons, it is common for bow hunters in many different jurisdictions, to hunt in tree stands above the ground.

Tree stands are normally positioned, as stated, from 10 to 15 feet above the ground. Obviously, the bow hunter must have a simple and efficient means for climbing to the initial height of the tree stand, to prepare the tree stand and for future entry to and from the tree stand. Various types of ladders exist which may be used to raise the bow hunter to the tree stand. These ladder type climbing devices often are provided in three sections and must be carried to the hunting site and assembled. This is often cumbersome and difficult for the bow hunter, as the hunting site may be a great distance from the parking site or starting point.

Various tree step solutions exist wherein rigid steps are provided into the tree trunk and removed when relocating to a different area, and this position is moved all season. Often six to eight steps are used in an alternating fashion to reach the above specified height. One type of step solution is the rigid self tapping rod type tree steps. These tree steps are usually manufactured from an extrusion of metal which may have a diameter from 2 mm to 10 mm. The rod style steps usually have two approximately 90 degree turns to provide a step function and a threaded end for entry and securing into the tree trunk.

Single fold tree steps include a formed step portion which is used to provide a step function and a pivotable screw for entry and securing into the tree trunk. Double fold tree steps include a formed step portion to provide a step function, an intermediate connecting section which is pivotably connected to the step portion and a pivotable screw for entry and securing into the tree trunk. The double fold tree step is the most advantageous in that it is foldable into a completely linear position and is easily carried in the pocket or hunting pack without large portions extending in any direction.

Hunting seasons in many northern locations may involve hunting in cold temperatures from 30 degrees Fahrenheit to 0 degrees Fahrenheit. Understanding this environment, it is often difficult and uncomfortable for the bow hunter to install the tree steps into the tree trunk, using bare hands without gloves or using bulky types of gloves. This is particularly true in installing the upper 3 or 4 steps, where the hunter may not be standing upon the ground completely and more than likely, the bow hunter may be positioned completely upon previously placed steps. Some forms of double fold tree steps have a foothold section that includes serrated edges which assist in providing a better grip for the footing but significantly increases the difficulty in bare handed installation of the step. In this instance, a lightweight, fast means for installing a tree step is required. This tree step installing tool must also be able to accommodate most types of tree steps including the rod style, single fold style and double fold style.

U.S. Pat. No. 4,275,621 to Mallot Sr. discloses an implement for attaching hangers, such as screw eyes, screw hooks and the like to surfaces particularly ceilings and walls in which the hanger is held in the body of the implement with the screw end directed outwardly. The hanger is secured by a pivoted cover which releases the hanger from the body upon a contact activator positioned on the implement contacting the ceiling or wall. Upon such contact the cover is opened and the continued rotation of the implement immediately frees the hanger from the implement without action by the operator.

U.S. Pat. No. 2,437,762 to Simonin discloses a tool used by telephone linemen to assist in installing a hook to support an insulator.

It is known that a metallic wrench step installer has been designed in an attempt to solve the above noted problems. The metallic wrench step installer is a relatively large tool which is designed to operate in driving only rod type tree steps. The wrench type step installer includes a shoulder section for a supporting the rod type tree step and has a length which is at least twice the size of the actual rod type tree steps. The metallic wrench step installer is bulky, heavy and not easily packable in a hunting sack. In addition, the metallic wrench step installer requires use of additional set screw type fasteners on both sides of the rod style tree step to adequately support and control the tree step during the driving motion.

SUMMARY OF THE INVENTION

A primary object of the present invention is to provide an inexpensive, lightweight tool for driving a variety of different types of tree steps, such as the rod type, single fold and double fold type tree steps.

Yet, still another object of the present invention is to provide a tool for driving double folding tree steps with relative ease and without discomfort to the hunter in various weather conditions.

A more specific object of the present invention is to provide a step driving tool including an elongated rigid body having a first end and an oppositely disposed second end, a front sidewall and an oppositely disposed back sidewall and a first connecting wall and a second connecting wall whereby the front sidewall, back sidewall, first connecting sidewall and second connecting sidewall all extend substantially from the first end to the second end of the elongated rigid body, the front sidewall and back sidewall are each connected at one side to the primary connecting sidewall and are each connected at an opposite side to the second connecting sidewall, the rigid body having a opening defined therein, at the first end, for receiving a tree step having an extending screw portion, the front sidewall including a notch starting at the first end of the rigid body and extending toward the second end for receiving the extending screw portion and a handle disposed on the second connecting sidewall of the rigid body and extending out away from the second connecting sidewall whereby when the handle is rotated, sufficient torque is transferred from the rigid body to the tree step to rotate the tree step into a tree trunk.

Another specific object of the present invention is to provide a step driving tool according to the description above wherein the handle is disposed at an approximately 90 degree angle to the surface of the second connecting sidewall, and upon rotation allows the rigid body to be rotated in a plane that is directly perpendicular to the axis of rotation of the tree step to provide easy driving of the tree step.

Another object of the present invention is to provide a step driving tool having a positive stop included within the opening of the body to prevent the tree step from falling past a predetermined position.

Still another object of the present invention is to provide a step driving tool wherein the handle includes a primary end and a secondary end and the secondary end is connected to the back side wall and the primary end is disposed opposite from the secondary end and the primary end includes a punch for creating a starting hole for the extending screw portion to begin screwing into for ease of driving.

Yet still another object of the present invention is to provide a step driving tool wherein said rigid body has a rectangular cross section and may be manufactured from a metallic extrusion or a plastic extrusion.

A still further object of the present invention is to provide a step driving tool including an elongated rigid body having a first end and an oppositely disposed second end, a front sidewall and an oppositely disposed back sidewall and a first connecting wall and a second connecting wall whereby the front sidewall, back sidewall, first connecting sidewall and second connecting sidewall all extend substantially from the first end to the second end of the elongated rigid body, the front sidewall and back sidewall are each connected at one side to the primary connecting sidewall and are each connected at an opposite side to the second connecting sidewall, the rigid body having a cavity defined therein between the front side wall and back side wall, the cavity being disposed between the first end and the second end of the rigid body, the front sidewall defining an entrance hole connected to the cavity, the back sidewall defining an exit hole also connected to the cavity, the entrance and exit holes being coaxially aligned with each other such that a tree step foothold is receivable completely through the entrance hole, cavity and exit hole, at least one crank shoulder affixed to the front side wall directly adjacent the entrance hole for positively contacting a tree step connector section when the tree step foothold is received within the entrance hole, cavity and exit hole and a handle disposed on the second connecting sidewall of the rigid body and extending out away from the second connecting sidewall whereby when the handle is rotated, sufficient torque is transferred from crank shoulder the tree step connector section to rotate the tree step into a tree trunk.

A yet still further more specific object of the present invention is to provide an elongated rigid body having a first end and an oppositely disposed second end, a front sidewall and an oppositely disposed back sidewall and a first connecting wall and a second connecting wall whereby the front sidewall, back sidewall, first connecting sidewall and second connecting sidewall all extend substantially from the first end to the second end of the elongated rigid body, the front sidewall and back sidewall are each connected at one side to the primary connecting sidewall and are each connected at an opposite side to the second connecting sidewall, the rigid body having a opening defined therein, at the first end, for receiving a tree step having an extending screw portion, the front sidewall including a notch starting at the first end of the rigid body and extending toward the second end for receiving the extending screw portion and the rigid body further having a cavity defined therein between the front side wall and back side wall, the cavity being disposed between the first end and the second end of the rigid body, the front sidewall defining an entrance hole connected to the cavity, the back sidewall defining an exit hole also connected to the cavity, the entrance and exit holes being coaxially aligned with each other such that a tree step having a tree step foothold is receivable completely through the entrance hole, cavity and exit hole, at least one crank shoulder affixed to the front side wall directly adjacent the entrance hole for positively contacting a tree step having a tree step connector section when the tree step foothold is received within the entrance hole, cavity and exit hole and a handle disposed on the second connecting sidewall of the rigid body and extending out away from the second connecting sidewall whereby when the handle is rotated, sufficient torque is capable of being transferred from the rigid body to the tree step to rotate the tree step into a tree trunk.

A further object of the present invention is to provide a method of manufacturing a step driving tool comprising the steps of folding a section of sheet metal to provide an elongated rigid body having a first end and an oppositely disposed second end, a front sidewall and an oppositely disposed back sidewall and a first connecting wall and a second connecting wall whereby the front sidewall, back sidewall, first connecting sidewall and second connecting sidewall all extend substantially from the first end to the second end of the elongated rigid body, the front sidewall and back sidewall are each connected at one side to the primary connecting sidewall and are each connected at an opposite side to the second connecting sidewall, providing an opening in the rigid body at the first end, for receiving a tree step having an extending screw portion, providing a notch in the front sidewall starting at the first end of the rigid body and extending toward the second end for receiving the extending screw portion, providing a cavity in the rigid body defined between the front side wall and back side wall, the cavity being disposed between the first end and the second end of the rigid body, providing an entrance hole in the front sidewall connected to the cavity providing an exit hole in the back sidewall also connected to the cavity, the entrance and exit holes being coaxially aligned with each other such that a tree step having a tree step foothold is receivable completely through the entrance hole, cavity and exit hole, providing at least one crank shoulder affixed to the front side wall directly adjacent the entrance hole for positively contacting a tree step having a tree step connector section when the tree step foothold is received within the entrance hole, cavity and exit hole, and affixing a handle on the second connecting sidewall of the rigid body and extending out away from the second connecting sidewall whereby when the handle is rotated, sufficient torque is capable of being transferred from the rigid body to the tree step to rotate the tree step into a tree trunk.

BRIEF DESCRIPTION OF THE DRAWINGS

FIG. 1 is an environmental view of a tree step installing tool of the present invention showing installation a rod type tree step into a tree trunk.

FIG. 2 is a perspective view of the tree step driving tool of the present invention shown with a rod type tree step.

FIG. 3 is a cross sectional view of a tree step driving tool of the present invention with a rod type tree step.

BEST MODE FOR CARRYING OUT THE INVENTION

Figure 4:
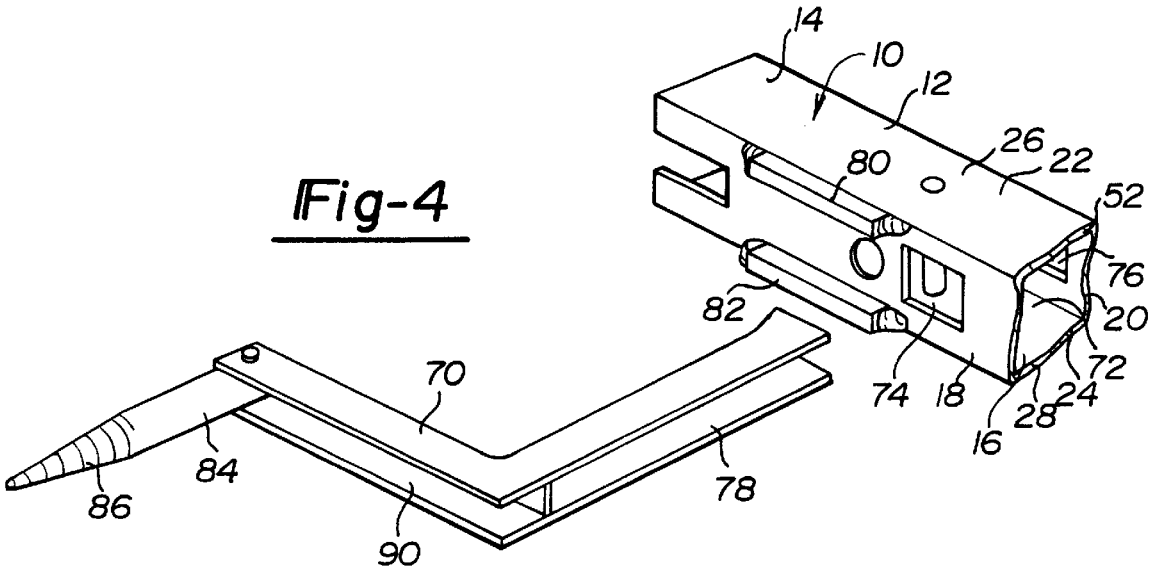
FIG. 4 is a perspective view of the tree step driving tool of the present invention shown with a single fold type tree step.

Referring now to FIGS. 1–3, there is shown generally, a step driving tool 10 of the present invention. The step driving tool is comprised of a rigid body 12 having a first end 14 and an oppositely disposed second end 16. The rigid body 12 also includes a front sidewall 18 and an oppositely disposed back sidewall 20. A first connecting wall 22 and a second connecting wall 24 are also shown as a part of the rigid body 12. The front sidewall 18, back sidewall 20, first connecting wall 22 and a second connecting wall 24 all extend substantially from the first end 14 of the rigid body 12 to the second end 16. The front sidewall 18 and back sidewall 20 are each connected at one side 26 to the first connecting sidewall 22 and are connected at the opposite side 28 to the second connecting sidewall 24.

Figure 6:
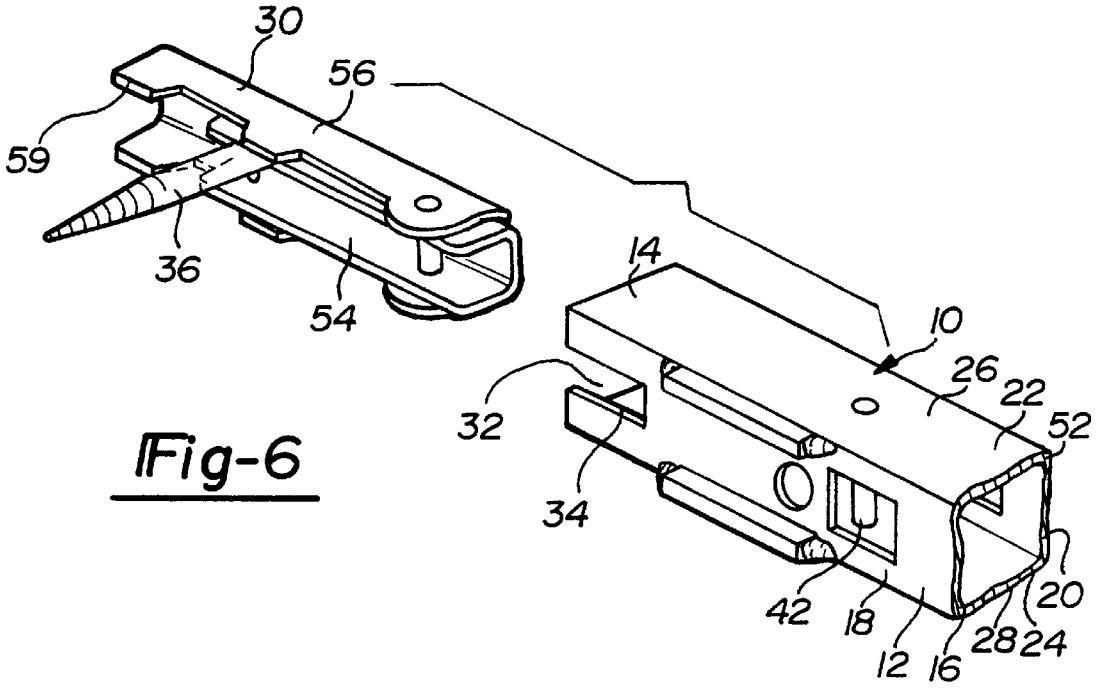
FIG. 6 is a perspective view of the tree step driving of the present invention shown with a double fold type tree step.
Figure 7:
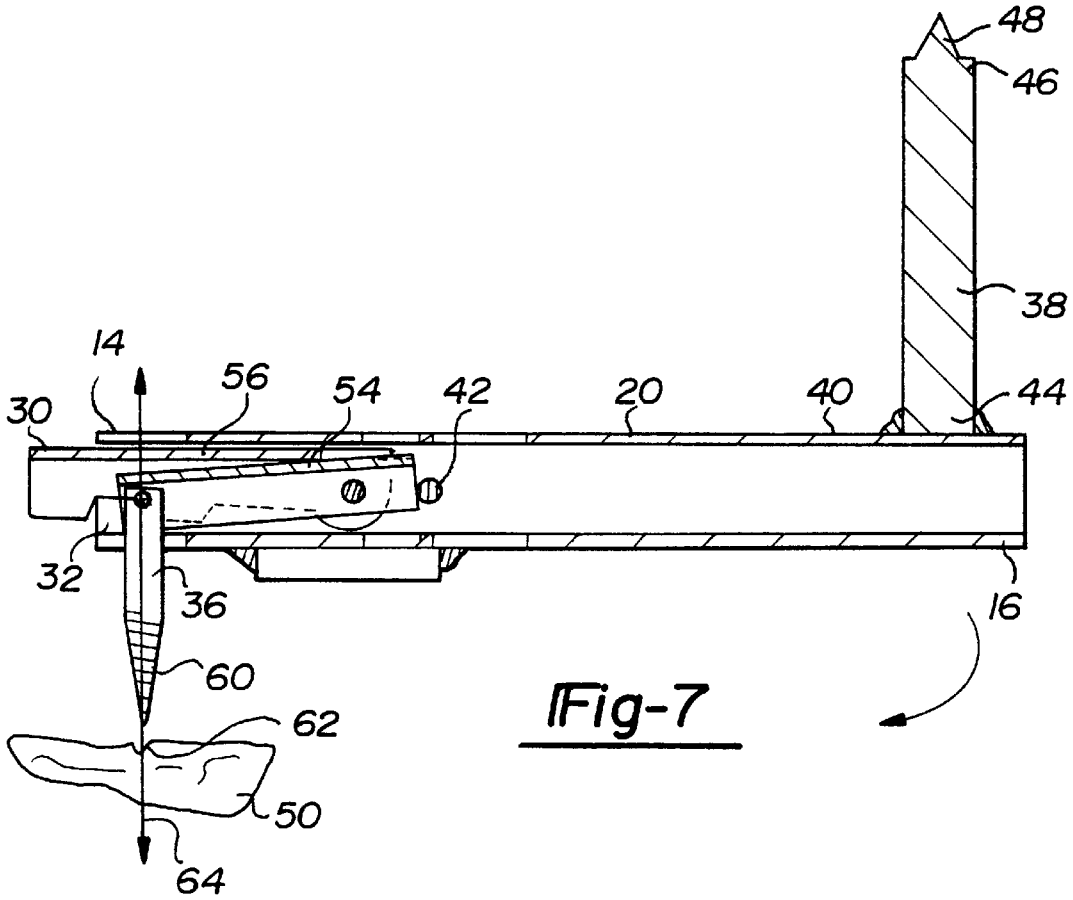
FIG. 7 is a cross sectional view of a tree step driving of the present invention with a double fold type tree step.

Referring now to FIGS. 6 and 7 there is shown a double fold tree step 30. The step driving tool 10 of the present invention defines an opening 32 at the first end 14 for receiving the tree step 30. The front sidewall 18 also defines a notch 34 which begins at the first end 14 and extends toward the second end 16. This notch, as shown in FIG. 6, is designed to receive the extending crew portion 36 of the double fold step 30. A handle 38 is affixed to and extends out from the back sidewall 20. In the preferred embodiment of the present invention, the handle 38 is affixed to the back sidewall 20 at an approximately 90 degree angle to the surface 40.

A positive stop 42 is shown in FIGS. 6 and 7 and is provided to stop the double fold tree step 30 from falling past a predetermined position within the opening 32 of the rigid body 12. The positive stop 42 is a rod type connection made from the first connecting sidewall 22 to second sidewall 24. In the preferred embodiment of the present invention, the handle 38 includes a primary end 44 and a secondary end 46. The primary end 44 is affixed to the back side wall 20 and the secondary 46 is disposed opposite the primary end. The secondary end 46 includes a punch 48. The punch 48 is provided to allow the hunter to swing the step driving tool 10 and strike the tree trunk 50 thereby creating a starting hole 62 for the screw portion 36.

The step driving tool of the present invention has a generally rectangular cross section 52 as shown in FIG. 6. It is contemplated that the preferred embodiment of the step driving tool may be manufactured from an extrusion of metal, such as iron, steel, stainless steel or aluminum. A rectangular extrusion shape allows for manufacture of the step driving tool rigid body which requires minimal working after the initial extrusion process. This allows for very effective and inexpensive mass quantity manufacturing. The step driving tool of the present may also be manufactured from a lightweight polymeric material such a carbon reinforced plastic or some other plastic capable or providing the desired structural characteristics needed to drive tree step into the tree trunk. The step driving tool of the present invention may also be folded from a sheet metal section, manufactured in a forging or powder metal formation operation, machined from a metal block, cast, die-cast or injection molded.

Having described the structural characteristics of the present invention, attention is now turned to the advantageous operational characteristics derived therefrom. Referring to FIGS. 6 and 7, there is shown the step driving tool 10 of the present invention in use in conjunction with a double fold tree step 30. The double fold tree step 30 is a very popular type of tree step which includes a screw portion 36, an intermediate section 54 and a foot hold section 56. As shown, the foot hold section 56 includes a serrated portion 59 which is used to retain the hunter's foot on the foot hold section while climbing. In attempting to install the double fold tree step 30 by hand, without any tools, the hunter would grasp the double fold tree step 30 and rotate the tree step 30 while trying to provide a force in the direction of the axis of rotation 64 of the screw portion 36 toward the tree trunk 50, until the screw portion catches. Once the screw portion 36 catches and the threaded portion 60 begins to drive into the tree trunk 50, continued rotation of the tree step 30 will eventually affix the tree step into the tree trunk 50.

As discussed previously, this operation is typically done in relatively cold temperatures in a range from 0 degrees to 30 degrees Fahrenheit. Further, grasping the serrated portion 59 of the foot hold section 56 and gaining adequate leverage to drive the threaded portion 60 is often very difficult and uncomfortable. This uncomfortableness and difficultness is often magnified if the hunter is already perched atop a previously installed tree step and had less balance and stability than if the hunter was on the ground.

Utilization of the step driving tool 10 of the present invention solves many of the above mentioned problems. Initially, the hunter grasps the rigid body 12, at the first end 14. The hunter then swings the step driving tool 10 such that the punch 48 lands on the tree trunk 50 and creates a starting hole 62. The double fold tree step 30 is then completely folded, as shown in FIGS. 6 and 7, and is inserted into the opening 32 within the rigid body 12. The extending screw portion 36 is received within the notch 34 defined within the front sidewall 18. This is shown in detail in FIG. 7. The tree step 30 is then situated such that the hunter now is able to easily place the threaded portion 60 of the screw portion 36 into the starting hole 62. The hunter, then provides a minimal amount of initial force in the direction of the axis of rotation 64 of the screw portion 36 until the threaded portion 60 catches within the tree trunk 50. At this point, the hunter simply rotates the step driving tool in a plane that is directly perpendicular to the axis of rotation 64 until the tree step 30 is completely driven into the tree trunk. An increased amount of torque is transferable from rigid body 12 to the tree step 30 due to the increased leverage provided by the length of the rigid body and other design characteristics of the step driving tool 10. In addition, the hunter is able to drive the tree step 30 into the tree trunk with much less effort and discomfort than driving the tree step with a bare hand. Removal of the tree step 30 is accomplished by placing the tree step 30 into the opening 32 and reversing the rotational direction of the step driving tool until the threaded portion 60 is removed from the tree trunk 50.

Figure 5:
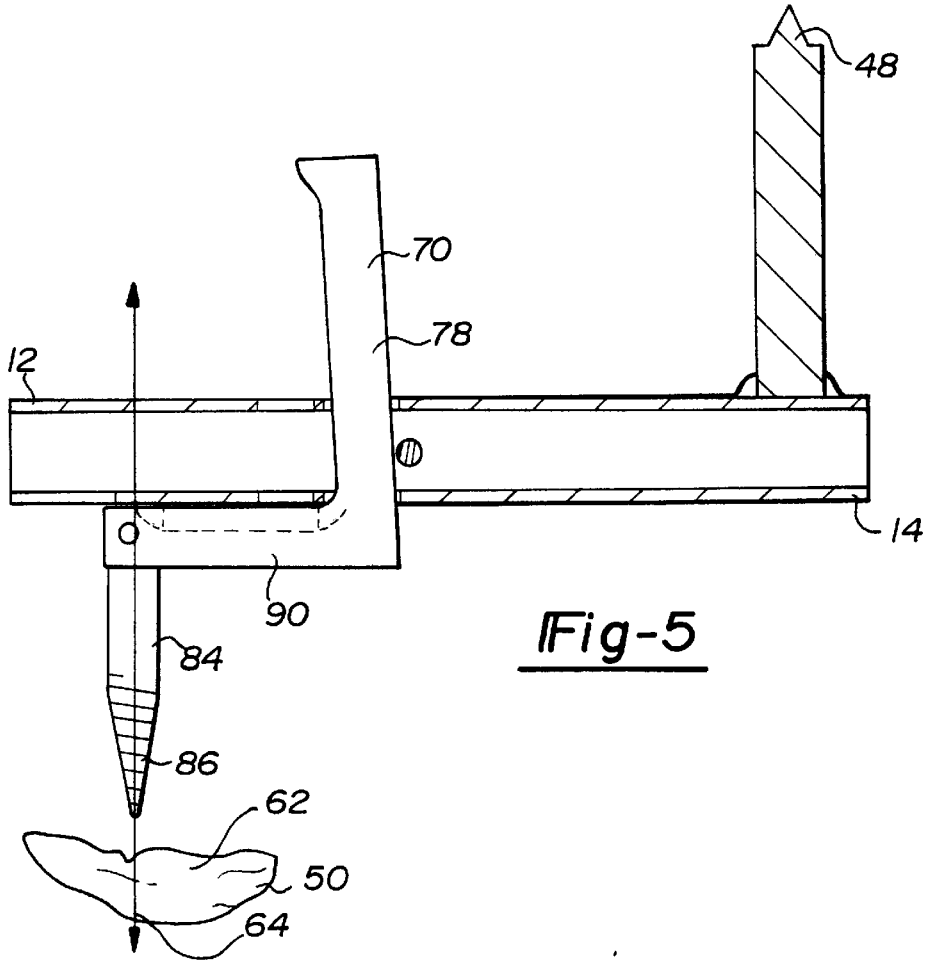
FIG. 5 is a cross sectional view of a tree step driving of the present invention with a single fold type tree step.

Having described the present invention as it relates to double fold tree steps 30, attention is now turned to FIGS. 4 and 5. There is shown a single fold tree step 70. The rigid body 12 includes a cavity 72 defined between the front side wall 18 and back side wall 20. The cavity is also disposed between the first end 12 and the second end 14. The front sidewall 18 also defines an entrance hole 74 which is connected to the cavity 72. The back side wall 20 defines an exit hole 76 which is also connected to the cavity 72. The entrance hole 74 and exit hole 76 are coaxially aligned with each other such that the single fold tree step foot hold is completely receivable through the entrance hole, 74, cavity 72 and exit hole 76. The entrance hole 74 and exit hole 76 are designed to mate with the cross section shape of the single fold tree step foot hold 78. The entrance hole 74 and exit hole 76 are designed to be only slightly larger in circumference to allow the tree step foot hold 78 to be received within the entrance hole 74 and exit hole 76.

The rigid body of the present invention also incudes a pair of crank shoulders 80 and 82. The crank shoulders 80 and 82 are affixed to the front side wall 18, and are located directly adjacent the entrance hole 74 and on opposite sides of each other.

In attempting to install the single fold tree step 70 by hand, without any tools, the hunter would grasp the single fold tree step 70 and rotate the tree step 70 while trying to provide a force in the direction of the axis of rotation 64 of the screw portion 84 toward the tree trunk 50, until the screw portion 84 catches. Once the screw portion 84 catches and the threaded portion 86 begins to drive into the tree trunk 50, continued rotation of the tree step 70 will eventually affix the tree step 70 into the tree trunk 50. As described above, this operation is often hindered by cold temperatures and decreased stability of the hunter when attempting to apply force and drive the tree step 70 into the tree trunk.

Utilization of the step driving tool 10 of the present invention to drive the single fold tree step 70 is substantially similar to the operation of the driving of the double fold tree step 30 except for the following differences. Initially, the hunter grasps the rigid body 12, at the first end 14. The hunter then swings the step driving tool 10 such that the punch 48 lands on the tree trunk 50 and creates a starting hole 62. The single fold tree step 70, and specifically the foothold 78 is then inserted into the entrance hole 74 and the cavity 72 of the rigid body 12. The foothold 78 further is placed completely through the cavity 72 and extends out of the exit hole 76. The tree step connector section 90 is received in between the crank shoulders 80 and 82 as shown in FIGS. 4 and 5. The tree step 70 is then situated such that the hunter now is able to easily place the threaded portion 86 of the screw portion 84 into the starting hole 62. The hunter, then provides a minimal amount of initial force in the direction of the axis of rotation 64 of the screw portion 84 until the threaded portion catches within the tree trunk 50. At this point, the hunter simply rotates the step driving tool in a plane that is directly perpendicular to the axis of rotation 64 until the tree step 70 is completely driven into the tree trunk. Depending on the direction of the threads contained on the threaded portion 86 and the direction of rotation, one crank shoulder will contact the tree step connector section 90. In the case shown in FIG. 5 for a standard tap direction being clockwise for driving in and counter clockwise for driving out, crank shoulder 82 will contact tree step connector section 90 and drive the tree step into the tree truck upon rotation of the step driving tool 10. An increased amount of torque is transferable from the crank shoulder 82 to the tree step 70 due to the increased leverage provided by the length of the rigid body and other design characteristics of the step driving tool 10. In addition, the hunter is able to drive the tree step 70 into the tree trunk with much less effort and discomfort than driving the tree step with a bare hand. Removal of the tree step 70 is accomplished by placing the tree step 70 into the opening cavity 72 and reversing the rotational direction of the step driving tool until the threaded portion 86 is removed from the tree trunk 50.

Referring now to FIGS. 1–3, there is shown yet another type of tree step, a rod tree step 100. The rod tree step 100, is the most inexpensive style tree step an is installable in substantially the same manner as the single fold tree step except that the rod tree step 100 is completely rigid. The cross section shape of the entrance hole 102 and exit hole 104 are designed to mate with the cross sectional shape of the tree step foot hold 106. In driving a rod tree step 100, the hunter grasps the rigid body 12, at the first end 14. The hunter then swings the step driving tool 10 such that the punch 48 lands on the tree trunk 50 and creates a starting hole 62. The rod tree step 100, and specifically the foothold 106 is then inserted into the entrance hole 102 and the cavity 110 of the rigid body 12. The foothold 106 further is placed completely through the cavity 110 and extends out of the exit hole 104. The tree step connector section 112 is received in between the crank shoulders 80 and 82 as shown in FIGS. 1 and 3. The tree step 100 is then situated such that the hunter now is able to easily place the threaded portion 114 of the screw portion 116 into the starting hole 62. The hunter, then provides a minimal amount of initial force in the direction of the axis of rotation of the screw portion 116 until the threaded portion 114 catches within the tree trunk 50. At this point, the hunter simply rotates the step driving tool in a plane that is directly perpendicular to the axis of rotation 64 until the tree step 100 is completely driven into the tree trunk. Depending on the direction of the threads contained on the threaded portion 86 and the direction of rotation, one crank shoulder will contact the tree step connector section 112. In the case shown in FIG. 1 and 3 for a standard tap direction being clockwise for driving in and counter clockwise for driving out, crank shoulder 82 will contact tree step connector section 112 and drive the tree step into the tree truck upon rotation of the step driving tool 10. An increased amount of torque is transferable from the crank shoulder 82 to the tree step 100 due to the increased leverage provided by the length of the rigid body and other design characteristics of the step driving tool 10. In addition, the hunter is able to drive the tree step 100 into the tree trunk with much less effort and discomfort than driving the tree step with a bare hand. Removal of the tree step 100 is accomplished by placing the tree step 100 into the cavity 110 and reversing the rotational direction of the step driving tool until the threaded portion 114 is removed from the tree trunk 50.

The present invention provides advantages of the prior art in that the step driving tool is compact and light weight. This compact feature allows the step driving tool to be included in the hunters pack when the hunter is travelling to the hunting site without worry of weight considerations. The light weight and compact feature is also important when the hunter has already installed a few tree steps and is balanced on such tree steps while trying to install higher level tree steps overhead. The lightweight, compact design of the present invention allows for easy carrying and manipulation of the step driving tool in all conditions. The step driving tool of the present invention is also capable of driving all three common types of tree steps, the rod type tree step, the single fold tree step and the double fold tree step.

Figure 8:
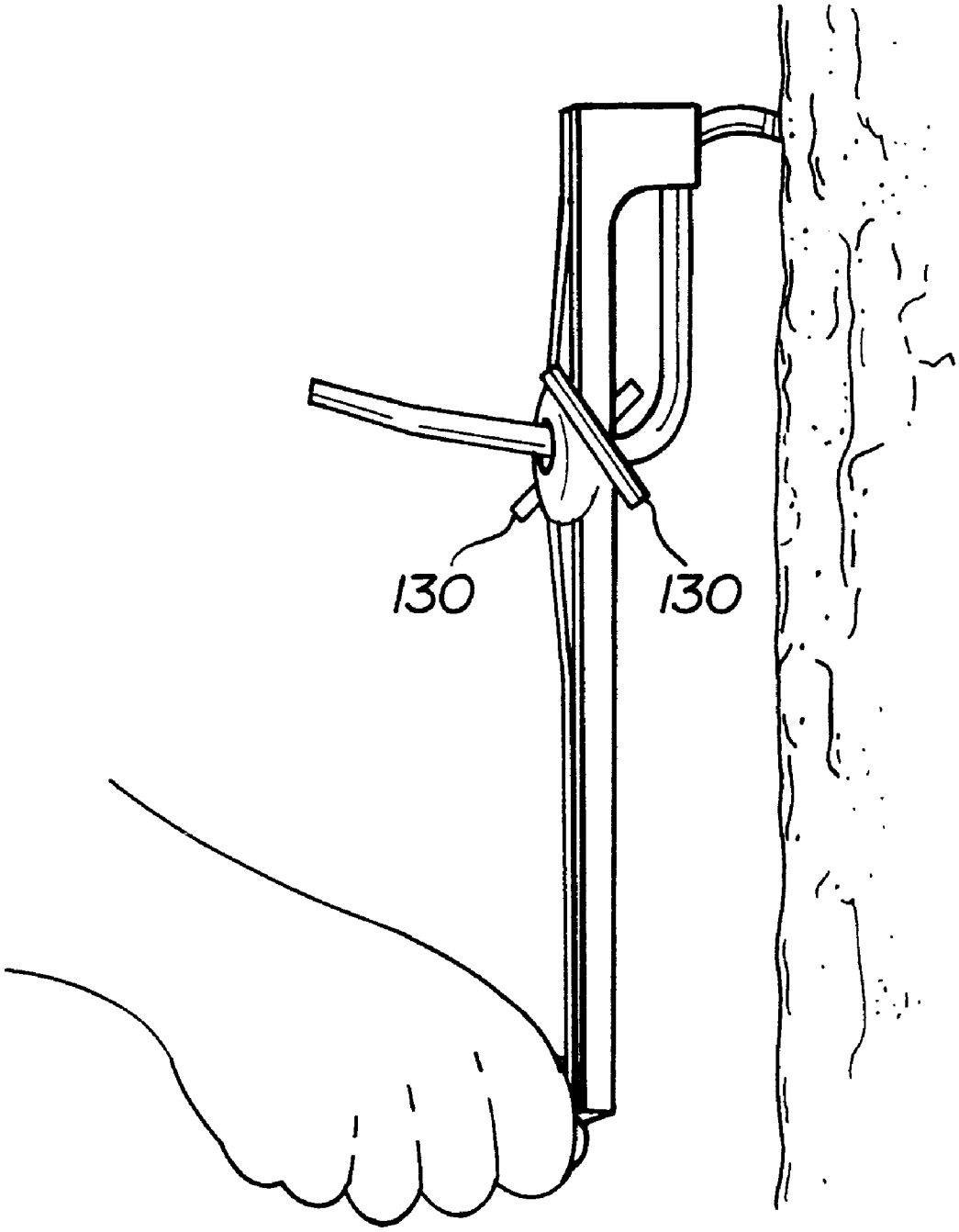
Fig-8 PRIOR ART
FIG. 8 is a perspective view of a prior art tree step installer for use only with rod type tree steps.

In contrast, the metallic wrench step installer of the prior art, as shown in FIG. 8, is a relatively large tool which is designed to operate in driving only rod type tree steps. The metallic wrench step installer is bulky, heavy and not easily packable in a hunting sack. In addition, the metallic wrench step installer requires use additional set screw type fasteners 130 on both sides of the rod style tree step to adequately support and control the tree step during the driving motion.

The best mode for carrying out the invention has been described in detail, those familiar with the art to which this invention relates will recognize various alternative designs and embodiments for practicing the invention as defined by the following claims.

What is claimed is:

1. A step driving tool comprising:

an elongated rigid body having a first end and an oppositely disposed second end, a front sidewall and an oppositely disposed back sidewall and a first connecting sidewall and a second connecting sidewall whereby said front sidewall, back sidewall, first connecting sidewall and second connecting sidewall all extend substantially from said first end to said second end of said elongated rigid body, said front sidewall and back sidewall are each connected at one side to said first connecting sidewall and are each connected at an opposite side to said second connecting sidewall;

said rigid body having a opening defined therein, at said first end, for receiving a tree step having an extending screw portion, said front sidewall including a notch starting at the first end of said rigid body and extending toward said second end for receiving said extending screw portion;

a handle disposed on said back sidewall of said rigid body and extending out away from said back sidewall whereby when said handle is rotated, sufficient torque is transferred from said rigid body to said tree step to rotate said tree step into a tree trunk; and a positive stop provided within the opening of said rigid body to prevent said tree step from, falling past a predetermined position.

2. The step driving tool of claim 1 wherein said handle is disposed at an approximately 90 degree angle to the surface of said back sidewall and upon rotation allows the rigid body to be rotated in a plane that is directly perpendicular to the axis of rotation of the tree step.

3. The step driving tool of claim 1 wherein said handle includes a primary end and a secondary end, said primary end is connected to said back sidewall and said second end is disposed opposite from said primary end, said secondary end including a punch for creating a starting hole.

4. The step driving tool of claim 1 wherein said rigid body has a rectangular cross section.

5. The step driving tool of claim 1 wherein said rigid body is manufactured from a rectangular extrusion of metal.

6. The step driving tool of claim 1 wherein said rigid body is manufactured from a rectangular extrusion of carbon reinforced plastic.

7. The step driving tool of claim 1 wherein said rigid body is manufactured from a rectangular extrusion of a polymeric material.

8. The step driving tool of claim 1 wherein said rigid body is manufactured from folded sheet metal.

9. A step driving tool comprising:

an elongated rigid body having a first end and an oppositely disposed second end, a front sidewall and an oppositely disposed back sidewall and a first connecting sidewall and a second connecting sidewall whereby said front sidewall, back sidewall, first connecting sidewall and second connecting sidewall all extend substantially from said first end to said second end of said elongated rigid body, said front sidewall and back sidewall are each connected at one side to said first connecting sidewall and are each connected at an opposite side to said second connecting sidewall;

said rigid body having a cavity defined therein between said front side wall and back side wall, said cavity being disposed between said first end and said second end of said rigid body, said front sidewall defining an entrance hole connected to said cavity, said back sidewall defining an exit hole also connected to said cavity, said entrance and exit holes being coaxially aligned with each other such that a tree step foothold is receivable completely through said entrance hole, cavity and exit hole;

at least one crank shoulder affixed to said front side wall directly adjacent said entrance hole for positively contacting a tree step connector section when said tree step foothold is received within said entrance hole, cavity and exit hole; and a handle disposed on said back sidewall of said rigid body and extending out away from said back sidewall whereby when said handle is rotated, sufficient torque is transferred from crank shoulder said tree step connector section to rotate said tree step into a tree trunk.

10. The step driving tool of claim 9 wherein said entrance hole and said exit hole have a cross sectional shape substantially identical to the tree step foothold.

11. The step driving tool of claim 9 wherein said handle is disposed at an approximately 90 degree angle to the surface of said back sidewall and upon rotation allows the rigid body to be rotated in a plane that is directly perpendicular to the axis of rotation of the tree step.

12. The step driving tool of claim 9 wherein said handle includes a primary end and a secondary end, said primary end is connected to said back sidewall and said primary end is disposed opposite from said secondary end, said secondary end including a punch for creating a starting hole for said extending screw portion.

13. The step driving tool of claim 9 wherein said rigid body has a rectangular cross section.

14. The step driving tool of claim 9 wherein said rigid body is manufactured from a rectangular extrusion of metal.

15. The step driving tool of claim 9 wherein said rigid body is manufactured from a rectangular extrusion of carbon reinforced plastic.

16. The step driving tool of claim 9 wherein said rigid body is manufactured from a rectangular extrusion of a polymeric material.

17. The step driving tool of claim 9 wherein said rigid body is manufactured from folded sheet metal.

18. The step driving tool of claim 9 further including an additional crank shoulder, whereby said at least one crank shoulder is disposed on one side of said entrance hole and said additional crank shoulder is located on the other side of said entrance hole.

19. A step driving tool comprising:

an elongated rigid body having a first end and an oppositely disposed second end, a front sidewall and an oppositely disposed back sidewall and a first connecting wall and a second connecting wall whereby said front sidewall, back sidewall, first connecting sidewall and second connecting sidewall all extend substantially from said first end to said second end of said elongated rigid body, said front sidewall and back sidewall are each connected at one side to said primary connecting sidewall and are each connected at an opposite side to said second connecting sidewall;

said rigid body having a opening defined therein, at said first end, for receiving a tree step having an extending screw portion, said front sidewall including a notch starting at the first end of said rigid body and extending toward said second end for receiving said extending screw portion; and said rigid body further having a cavity defined therein between said front side wall and back side wall, said cavity being disposed between said first end and said second end of said rigid body, said front sidewall defining an entrance hole connected to said cavity, said back sidewall defining an exit hole also connected to said cavity, said entrance and exit holes being coaxially aligned with each other such that a tree step having a tree step foothold is receivable completely through said entrance hole, cavity and exit hole;

at least one crank shoulder affixed to said front side wall directly adjacent said entrance hole for positively contacting a tree step having a tree step connector section when said tree step foothold is received within said entrance hole, cavity and exit hole; and a handle disposed on said back sidewall of said rigid body and extending out away from said back sidewall whereby when said handle is rotated, sufficient torque is capable of being transferred from said rigid body to said tree step to rotate said tree step into a tree trunk.

20. The step driving tool of claim 19 wherein said handle is disposed at an approximately 90 degree angle to the surface of said back sidewall and upon rotation allows the rigid body to be rotated in a plane that is directly perpendicular to the axis of rotation of the tree step.

21. The step driving tool of claim 19 wherein a positive stop is provided within the opening of said rigid body to prevent said tree step from falling past a predetermined position.

22. The step driving tool of claim 19 wherein said handle includes a primary end and a secondary end, said primary end is connected to said back side wall and said primary end is disposed opposite from said secondary end, said secondary end including a punch for creating a starting hole for said extending screw portion.

23. The step driving tool of claim 19 wherein said rigid body has a rectangular cross section.

24. The step driving tool of claim 19 wherein said rigid body is manufactured from a rectangular extrusion of metal.

25. The step driving tool of claim 19 wherein said rigid body is manufactured from a rectangular extrusion of carbon reinforced plastic.

26. The step driving tool of claim 19 wherein said rigid body is manufactured from a rectangular extrusion of a polymeric material.

27. The step driving tool of claim 19 wherein said rigid body is manufactured from folded sheet metal.

* * * * *